US005167521A

United States Patent [19]

Wilfert

[11] Patent Number: 5,167,521

[45] Date of Patent: Dec. 1, 1992

[54] PLUG CONNECTOR WITH WATERTIGHT YET GAS-POROUS SEAL

[75] Inventor: Thomas Wilfert, Ludwigsburg, Fed. Rep. of Germany

[73] Assignee: Robert Bosch GmbH, Stuttgart, Fed. Rep. of Germany

[21] Appl. No.: 753,227

[22] Filed: Aug. 30, 1991

[30] Foreign Application Priority Data

Oct. 4, 1990 [DE] Fed. Rep. of Germany ..... 4031256

[51] Int. Cl.[5] ..... H01R 13/52

[52] U.S. Cl. ..... 439/275; 439/933

[58] Field of Search ..... 439/271-283, 439/586, 587, 578, 585, 933

[56] References Cited

U.S. PATENT DOCUMENTS

| | | | |
|---|---|---|---|
| 2,605,315 | 7/1952 | Hargett | 439/275 |
| 3,847,463 | 11/1974 | Hayward et al. | 439/578 |
| 4,357,067 | 11/1982 | Labbe et al. | 439/578 |
| 4,360,245 | 11/1982 | Nikitas | 439/578 |
| 4,722,696 | 2/1988 | Ballhause | 439/275 |
| 5,067,912 | 11/1991 | Buckford et al. | 439/578 |

*Primary Examiner*—David L. Pirlot

*Attorney, Agent, or Firm*—Frishauf, Holtz, Goodman & Woodward

[57] ABSTRACT

Electrical plug connectors used in humid locations are provided with sealing elements (16, 26) at their cable ends and at their plug ends, which results in an enclosed volume of air in the interior space (27) of the plug connector. If there are fluctuations in temperature and/or pressure in the surrounding space (19), the interior space (27) is at relative overpressure or underpressure; the underpressure situation leads to seepage of water into the plug connector. In accordance with the invention, this is avoided by forming the sealing elements (16,26) of an air-transmissive yet water-repellant material, preferably polytetrafluoroethylene (PTFE), so that they can also serve as pressure equalizing elements. Plug connectors according to the invention are particularly well suited for use in spaces subjected to wide-ranging temperatures and/or to water infiltration resulting from high ambient humidity.

4 Claims, 1 Drawing Sheet

PLUG CONNECTOR WITH WATERTIGHT YET GAS-POROUS SEAL

Cross-reference to related patent, assigned to the assignee of the present invention, the disclosure of which is incorporated by reference:

U.S. Pat. No. 4,722,696, BALLHAUSE, entitled ENVIRONMENTALLY AND ABUSE-PROTECTED PLUG CONNECTOR, based on German P 35 45 223.

FIELD OF THE INVENTION

The present invention relates generally to a plug connector and, more particularly, to one with an improved seal of a watertight yet gas-porous material such as PolyTetraFluoroEthylene (PTFE).

BACKGROUND

It is generally known to use an annular or ring seal, e.g. in the form of a stopper bushing, to seal a connecting cable, composed of multiple conductors, in the entry section of an electrical plug connection. This is intended to prevent moisture from seeping, along the outer surface or cladding of the connecting cable, into the plug connection.

If the plug-connection-remote interior section of the connecting cable is located in a moisture-filled space, there can result an undesirable transport of moisture within the connecting cable, along the conductors, which cannot be stopped merely by an annular seal around the connecting cable.

In such a case, one employs a more elaborate and costly individual conductor seal, as described in German published application DE-OS 35 45 223 and corresponding U.S. Pat. No. 4,722,696. Here, the connecting cable is "feathered" at the electrical plug connection into the individual conductors, and each individual conductor is provided with an annular seal.

According to this costly method, it is usual to provide a seal on the housing of the plug connector, for example in the form of an O-ring on a cylindrical portion of the housing, in order to seal the plug and socket against the external space, which is under atmospheric pressure.

By means of this outer seal, on the one hand, and by means of the sealing of the individual conductors, on the other hand, an air volume is defined in the plug connection. Temperature changes, and ambient air pressure changes, mean that this trapped or enclosed air volume is alternately at overpressure or underpressure, compared to the ambient air. When the enclosed air volume is at underpressure, and water is present in the space surrounding the plug connection, micropores in the outer seal and other seal result in undesirable aspiration of water into the interior space of the plug connection. This must be prevented or at least minimized.

THE INVENTION

Accordingly, it is an object of the present invention to improve the known electrical plug connection by keeping its interior dry, even when pressure equalizing events occur in the enclosed air volume thereof.

Briefly, this is achieved by using air-transmissive yet water-resistant materials such as polytetrafluoroethylene (PTFE), sometimes referred to by the trademark TEFLON, to form the seals, so that, even when the interior space of the connector housing is at relative underpressure, no water will penetrate the interior; rather, oxygen and/or nitrogen will diffuse through the seal enough to equalize the interior and exterior pressures, but water and water vapor will be excluded. Similarly, when the exterior pressure drops, leaving a relative overpressure in the interior, gas will diffuse out to equalize. This equalization also reduces the tendency toward formation of fissures, which could subsequently facilitate entry of water.

DRAWINGS

The single Figure shows a plug connector on the left, plugged into or coupled to a mating element on the right.

DETAILED DESCRIPTION

Figure 1:
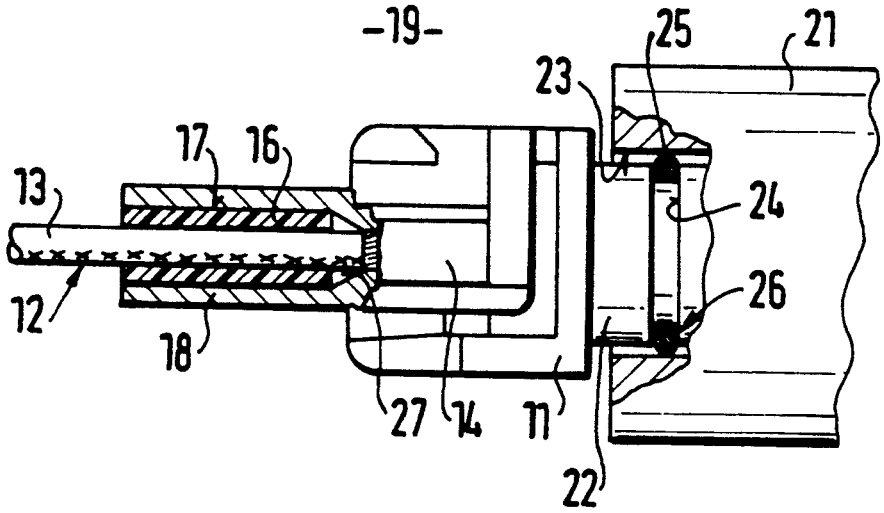

The plug connector of the present invention features a housing 11, preferably formed of an insulating plastic by injection molding. A connecting cable 12 is fed into housing 11 Connecting cable 12 typically includes multiple conductors 13, although for ease of illustration, only one is shown. Each conductor 13 engages with a respective terminal 14 mounted inside housing 11.

Around each conductor 13, a tubular seal 16 is mounted, wrapped or shrunk-fit. A protective sleeve 18 protrudes from housing 11 around cable 12, and seal(s) 16 completely fill the annular space between conductors 13 and protective sleeve 16. Thus, cable 12 is protected from excessive flexing or wear as it leaves housing 11, and the interior space 27 inside housing 11 is protected from corrosive water seeping along cable 12 from the surrounding space 19, which is at fluctuating atmospheric pressure.

Conversely, at the prong side of the plug connector, another seal 26, such as an O-ring, is interposed at the interface between the plug connector and its mating element or socket 21, which mechanically may be of any suitable and well-known structure. In accordance with the invention, the O-ring may also be of PTFE, although clearly the pressure equalization function will be performed if either seal 16 or seal 26 is air-transmissive yet water-resistant.

In the preferred embodiment, the plug connector features a cylindrical extension 22 of housing 11, which extends at the prong side into a facing cylindrical recess 23 of mating element 21, with some play. Extension 22 is formed with an annular groove 24, in which is mounted a sealing ring 25, which presses against the inner annular surface of cylindrical recess 23. Thus, an outer seal 26 is formed between elements 11 and 21. By virtue of the cable-end seal 16 and the prong-end seal 26, a sealed interior space 27 is defined within housing 11, into which no corrosive moisture can penetrate. Mating element 21 preferably is equipped with similar PTFE seals, but these are omitted from the drawing, for simplicity of illustration.

Interior space 27 is a sealed volume of air, which no longer freely communicates with surrounding ambient air space 19.

If the temperature and/or pressure in space 19 were to change, an absolute functioning of seal 16 and seal 26 would create an overpressure or underpressure in interior space 27. However, microscopic leaks in such absolute seals, which in practice have not been completely avoidable, have resulted in slow equalization of pressure differences with space 19. According to the prior art, whenever interior space 27 was at underpressure and conductors 13 or mating element 21 was in contact with water, the water would seep into the plug connector or mating element.

Instead of the prior art attempt at absolute seals, the present invention features an air-transmissive seal material, preferably polytetrafluoroethylene (PTFE). Preferably, PTFE foil is used for seal 16 and/or seal 26. This foil has the characteristic, due to its high surface tension, that resistance to water is high, while resistance to passage of gases such as oxygen and nitrogen is low.

Forming seal 16 and/or seal 26 as a PTFE pressure equalizing element substantially prevents entry of water into the plug connector, yet permits pressure equalization between interior space 27 and surrounding space 19, so that pressure differentials between them do not persist, and suction effects, on water which happens to be in space 19, no longer occur. This effect, accentuated by the water-repellant performance of PTFE foil, provides assurance that interior space 27 of the plug connector will remain water-free, uncorroded, and in functioning condition.

By equipping mating element 21 with pressure equalizing elements similar to seals 16, 26, one can assure the same pressure equalization benefits in the mating element coupled to the plug connector.

As an alternative to the above-described preferred embodiment, one could provide still further pressure equalizing elements 16, in order to provide redundancy in case of clogging, to speed up pressure equalization, and to further assure the operability and functional readiness of the the plug connector.

Various changes are possible within the scope of the inventive concept, and features of one embodiment may be combined with features of a different embodiment.

I claim:

1. Electrical plug connector having a housing (11) with at least one electrical terminal portion (14);

a conductor (13) associated with each terminal portion (14);

a protective sleeve (18) extending from said housing (11) and surrounding each conductor (13) adjacent said housing (11);

a first seal (16) interposed between each conductor (13) and its respective protective sleeve (18);

said housing (11), protective sleeve (18) and first seal (16) defining therebetween a hollow interior space (27);

wherein, the electrical plug connector is adapted for coupling to a mating element (21);

a second seal (26) is provided at an interface between said plug connector and said mating element (21);

said first and second seals (16, 26) together sealing said interior space (27) from an exterior space (19) surrounding the plug connector and mating element (21); and at least one of said seals (16, 26) is a gas-porous yet water-resistant polytetrafluoroethylene (PTFE) foil element having a surface exposed to said exterior space (19), and thus serves as a pressure equalization element between said exterior surrounding space (19) and said interior space (27).

2. Plug connector according to claim 1, wherein the pressure equalizing element (16, 26) has a tubular form.

3. Plug connector according to claim 1, wherein said surrounding space (19) is under atmospheric pressure.

4. Plug connector according to claim 3, wherein said mating element (21) is equipped with similarly-operating first and second seals.

* * * * *